United States Patent [19]

Spies

[11] Patent Number: 4,625,815

[45] Date of Patent: Dec. 2, 1986

[54] DRILLING EQUIPMENT, ESPECIALLY FOR USE IN UNDERGROUND MINING

[76] Inventor: Klaus Spies, Frennetstr. 49, 5100 Aachen-Schmithof, Fed. Rep. of Germany

[21] Appl. No.: 614,433

[22] Filed: May 25, 1984

[30] Foreign Application Priority Data

Jun. 22, 1983 [DE] Fed. Rep. of Germany ..... 3322427

[51] Int. Cl.[4] ..... E21C 1/00; E21C 5/00

[52] U.S. Cl. ..... 175/73; 175/78; 173/147; 464/19

[58] Field of Search ..... 175/73, 74, 89, 90, 175/231, 325, 78, 61, 62; 173/22, 147, 148, 34, 150; 464/19, 58, 183, 7, 149, 173; 198/339, 341, 345; 299/33, 17

[56] References Cited

U.S. PATENT DOCUMENTS

| | | | |
|---|---|---|---|
| 1,472,782 | 11/1923 | Barber | 464/57 X |
| 2,631,821 | 3/1953 | Caldwell | 175/78 |
| 2,637,527 | 5/1953 | Andrews | 173/35 X |
| 2,644,669 | 7/1953 | Curtis et al. | 173/35 X |
| 3,149,540 | 9/1964 | Lindgren et al. | 173/147 X |
| 3,738,433 | 6/1973 | O'Leary | 173/147 |
| 3,995,700 | 12/1976 | Mayer | 173/2 |
| 4,007,797 | 2/1977 | Jeter | 175/26 |
| 4,122,936 | 10/1978 | Johnson | 198/339 |
| 4,149,391 | 4/1979 | Driver | 464/19 |
| 4,368,786 | 1/1983 | Cousins | 464/19 X |
| 4,527,639 | 7/1985 | Dickinson, III et al. | 175/78 X |

FOREIGN PATENT DOCUMENTS

| | | |
|---|---|---|
| 3029963 | 3/1972 | Fed. Rep. of Germany . |
| 3043512 | 6/1981 | Fed. Rep. of Germany . |
| 3141856 | 6/1982 | Fed. Rep. of Germany . |

*Primary Examiner*—James A. Leppink
*Assistant Examiner*—David J. Bagnell
*Attorney, Agent, or Firm*—Karl F. Ross; Herbert Dubno

[57] ABSTRACT

The invention relates to a drilling equipment whose annular bit (4) for cutting the rock located in the deepest point of the drill hole is provided with high-pressure water-jet nozzles and is connected via a flexible high-pressure hose pipe (13) with a high-pressure pump. In order to be able to drill with the aid of such a drilling equipment small-diameter drill holes of high directional stability, the invention proposes that the high-pressure hose pipe (13) be constructed to be rigid under torsion, non-rotatably connected to the annular bit (4) and the turning drive (24, 25) of the drilling machine (8) and to be journaled in a non-rotatable jacket tube (15) elastically deflectable from the extension position, said jacket tube being rigid in radial direction and guided in the area of the drill hole mouth in a deflecting device (7) and displaceable together with the high-pressure hose pipe (13) in its longitudinal direction.

10 Claims, 5 Drawing Figures

DRILLING EQUIPMENT, ESPECIALLY FOR USE IN UNDERGROUND MINING

FIELD OF THE INVENTION

The invention relates to drilling equipment, especially for underground mining, whose annular bit for cutting the rock, located in the deepest point of the bore hole, has high-pressure water-jet nozzles and is connected to a high-pressure pump through a flexible high-pressure hose.

BACKGROUND OF THE INVENTION

Drilling equipment of this type known in the art (German open application No. 31 41 856) has the particular advantage that no rigid drilling rod is required. The flexible high-pressure hose pipe allows boring in a single operation from narrow mine openings of drill holes in any direction and of any length limited only by the length of the high-pressure hose.

But the known drilling equipment of this kind has the disadvantage that drill holes made by it must have a very large diameter and can be kept directionally constant only with difficulty. The relatively large diameter is necessary because in the case of the known drilling equipment the turning mechanism and the advance mechanism are located in the deepest point of the drill hole and require the corresponding space. Because of the relatively large diameter the known drilling equipment can be used economically only in easy drillable rocks, for instance for drilling in coal-bearing strata, for making water-injection holes, but cannot be used in hard rock for making small-diameter rock-anchoring holes or blast holes. The directional stability is deficient, because the high-pressure hose pipe cannot provide a guide for the annular bit.

According to German open application No. 30 29 963 drilling equipment can have a small-diameter annular bit for cutting the rock with high-pressure water-jet nozzles. In this case, however, rotationally driven hollow and rigid drill bars are used for feeding the high-pressure water and therefore, this equipment has no significant advantage over the commonly known drilling equipment with rigid drill bars.

Finally, according to U.S. Pat. No. 4,057,115 and German open application No. 30 43 512 drilling equipment can use a flexible shaft instead of drill bars, said shaft stiffening to a rigid bar under torque. For this purpose, the flexible shaft consists of an inner flexible element and an outer helically wound spring element which is also flexible and when a correspondingly strong torque is applied, its diameter narrows so that it presses against the inner element from the outside and together they form a stiffened unit. In the case of this already known drilling equipment, this supple shaft is engaged immediately downstream of the hole mouth by the turning- and advance mechanism, so that only the section of the flexible shaft located within the drill hole is stiffened, while the section of the flexible shaft located behind the turning- and advance mechanism remains supple. This allows the drill bar to distort in any direction.

The latter drilling equipment did not yield satisfactory results in practice, because the rigidity of the stiffenable flexible shaft was not sufficient to transmit the advance forces and torque required for the drilling operation. Moreover, due to the friction of the insufficiently rigid flexible shaft against the wall of the drill hole the wear is extraordinarily high. Finally, the directional stability in this case is also poor, due to the strong advance forces to be transmitted and the thereto related deflections of the stiffened section of the flexible shaft.

OBJECT OF THE INVENTION

It is the object of the invention to further develop the drilling equipment of the afore-cited art, in order to make it suitable for angularly drilling directionally stable small-diameter drill holes, for instance for making anchor holes or blast holes.

SUMMARY OF THE INVENTION

To attain this object, the invention departing from a drilling equipment of the afore-mentioned type, uses a high-pressure hose pipe which is torsion-rigid, connected torsionally stiff with the annular bit and the turning mechanism of the drilling machine and be pivoted into a not rotatable and elastically deflectable from the extension position jacket tube, said jacket tube being constructed to be rigid in radial direction, guided in a deflection device in the area of the hole mouth and displaceable together with the high-pressure hose pipe in its longitudinal direction.

The invention is based on the principle that when drilling with high-pressure water-jet nozzles, relatively small advance forces and torques have to be transmitted. Only the friction resulting from the rotation of th nozzle-equipped annular bit and of the high-pressure base have to be overcome by thr torque to be transmitted. The advance force has to compensate only for the weight of the nozzle-equipped annular bit, the high-pressure hose and the jacket tube, as well as for the backlash force of the nozzles. For the drilling operation itself no torque or advance forces have to be transmitted. Due to that, a torsion-rigid high-pressure hose pipe is fully sufficient here for transmitting the relatively reduced torque. Likewise, for transmittinig the relatively reduced advance forces an adequately stiff jacket casing, elastically deflectable from the extension position, is sufficient. Due to the fact that the jacket tube is not rotatable it can be guided in the area of the drill hole mouth in a particularly simple manner in a deflection device and creates, due to its elastical restoring forces in the drill hole a sufficiently accurate guidance for the annular bit, so that a directionally constant hole is ensured.

It is possible for instance, with the aid of the drilling equipment according to the invention, to form in a single operation and from a narrow strut space anchor holes of any desired length in the roof strata, holes having a length corresponding to a multiple of the thickness of the stratum.

In the case of mechanical face advancement, where the extraction machine occupies the essential portion of the gallery cross-section, it is possible with the aid of the drilling equipment according to the invention to drill achor holes of any length from the marginal area of the gallery, the direction of the holes running angularly with respect to the longitudinal direction of the gallery. In the same way, it is possible to perform from the marginal area of the gallery blast holes angled withe respect to the face.

A preferred embodiment of the drilling equipment according to the invention provides for the jacket tube to consist of a spiral spring made of spring steel wire wound with turns adjacent one another. Such a jacket tube is cheap and easy to fabricate, has a relatively high rigidity in the extension position and yet allows for any deviation in the area of the deflection device without changing its diameter.

Furthermore, it is provided that the high-pressure hose be surrounded by a wear-resistant casing, particularly in the form of a narrow spiral spring wound around the high-pressure hose. This spiral spring protects the high-pressure hose against wear and moreover, contributes to a certain extent to the ridigity under torque of the high-pressure hose.

In order to keep the friction between the jacket tube and the high-pressure hose as low as possible, the jacket tube is coated in a liquid-proof manner at its inner- and/or outer wall and the annular space between the jacket tube and the high-pressure hose is filled with grease.

In order to provide an accurate guidance for the jacket tube in the deflection area over a sufficient length, the deflection device comprises a deflection roller and an angularly adjustable guide in the form of a roller chain with guide wheels and which guides the jacket tube past the deflection roller.

For the purpose of starting a new drill hole the deflection device has a drill guide which is displaceable and fastenable along a guiding curve for changing the deflection angle, said drill guide cooperating with the roller-chain guide, whereby the guiding curve is shaped to ensure that roller-chain guide is always tensioned and to create an optimal biending radius for the jacket tube. This deflection device allows to bring in the right position for drilling the jacket tube and the high-pressure hose guided therein with the nozzle-equipped annular bit attached to its extremity and to maintain the jacket tube in the correctly angled position during the entire drilling operation.

In order to avoid contamination of the drill guide and the thereto connected deflection device by the drill mud leaving the hole these parts are protected by a sheath positioned over the center bit device.

In order to ensure a rectilinear run of the jacket tube outside the drill hole the deflection device contains live rollers keeping the jacket tube longitudinally tensioned between the deflection device and the drilling machine.

The drilling machine is advantageously supported by a drill carriage and is movable in the longitiudinal direction of the carriage by means of an adjustable advance drive due to the thrust of the jacket tube and the high-pressure hose fulcrumed therein. Since the longitudinal axis of the drill carriage can run at any angle with respect to the longitudinal axis of the drill hole, such a drill carriage can be located without problems for instance on the face floor or in the marginal area of the gallery.

Suitably, a rotatable pressure-water inlet is located at the beginning of the high-pressure hose for supplying high-pressure water to the high-pressure hose. In order to keep this pressure-water inlet free fom the influence of the axially directed pressure forces, a hollow shaft connected with the high-pressure hose rotatingly entrained by the turning mechanism of the drilling machine is provided, said shaft being fulcrumed in the pressure housing subjectd to pressure water, provided centrally with openings for the supply of the pressure water and sealed on both sides of the center against the pressure housing by means of symmetrically arranged insulating sleeves.

In order to keep the insulating sleeves sealed in spite of the very high water pressure, the invention further provides that the insulating sleeves be subjected on their back sides to a second pressure medium of a higher viscosity, having a pressure slightly higher than that of the water. This second medium of high viscosity prevents the passage of the high-pressure water through the insulating sleeves, but reaches the pressure water in only very small quantities as a result of its higher viscosity.

In order to automatically keep the pressure in the second pressure medium of a higher viscosity in a permanent correct relationship with the instantaneous pressure of the pressure water, a pressure transmitter is provided between the high-pressure water and the higher-viscosity medium, having a pressure multiplying ratio of 1:1.1 and 1:2.

Finally, the advance speed of the driving rollers of the deflecting device, the turning speed of the drilling machine and the service pressure of the high-pressure pump are adjusted in an advantageous way so that depending on the hardness of the rock to be drilled an optimal drilling results even when the hardness of the rock to be drilled changes.

Furthermore, the advance speed of the advance mechanism of the drilling machine and the advance speed of the drive roller so the deflection device are advantageously coordinated with respect to each other in such a way that the jacket tube is maintained uniformly rigid between the drilling machine and the deflection device. Thus the advance mechanism of the drive rollers does not have to pull the heavy drilling machine. On the other hand, I avoid bending of the jacket tube laterally between the drilling machine and the deflection device.

SPECIFIC DESCRIPTION

Figure 1:
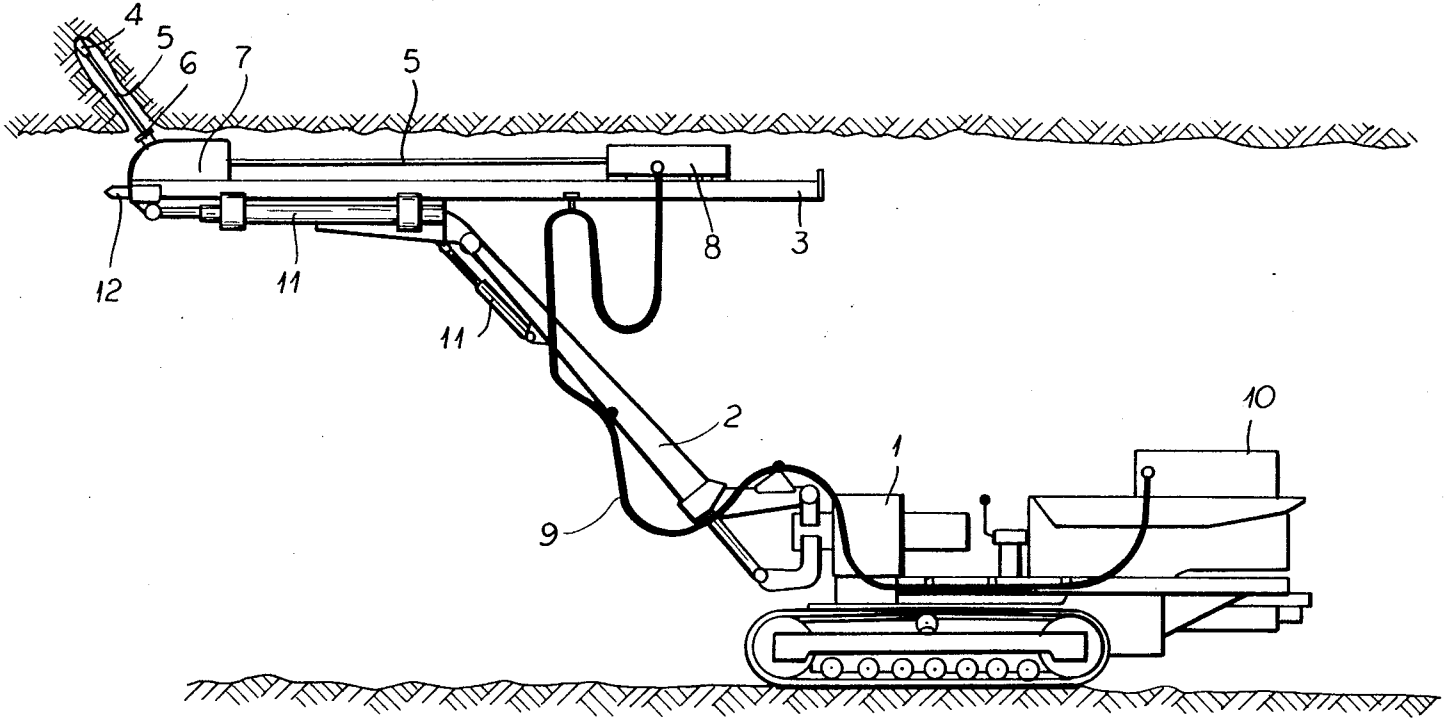
FIG. 1 is a side elevational view of a drilling machine according to the invention shown schematically.

As can be seen in FIG. 1, the equipment for angular drilling is mounted on a regular drill chuck 1 with a swingable arm 2 and a drilling carriage 3. Instead of the drill truck another kind of manipulator can receive the drill carriage 3, such as a unit suitable for mechanical face advancement or for drilling anchor holes in exploitation struts.

A nozzle-equipped annular bit 4 is mounted to the free end of a pressure supply system which in its totality is marked with the reference numeral 5 and is deflectable immediately before the hole mouth 6 by means of a deflection device 7. The drilling machine 8 is displaceable on the drill carriage 3 in the longitudinal direction thereof. The high-pressure water is supplied to the drilling machine 8 by a high-pressure pump 10 via a high-pressure hose-pipe connection. The turning-and swinging cylinder 11 as well as a stopping device 12 for securing in position the drill carriage 3 complete the apparatus. During the drilling process, the drilling machine 8 moves towards the drill hole on the carriage 3, while the deflection of the pressure feeding system 5 takes place in the deflection mechanism 7. The length of the angled drill hole is not determined by the narrowness of the mine opening but solely by the lifting motion of the drilling machine 8 on the drill carriage 3, as well as by the total length of the pressure supply system 5.

Figure 2:
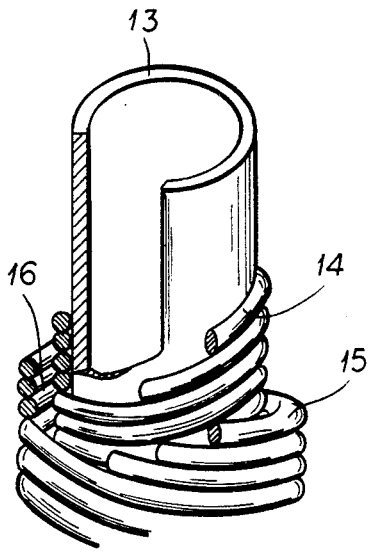
FIG. 2 is a fragmentary perspective view of the assembly of the high-pressure hose pipe and the jacket tube partly broken away.

The pressure supply system 5 shown in FIG. 2 consists of a high-pressure hose pipe 13 constructed to be rigid under torque, having a clear cross-section dimensioned to permit the supply of the required water quantity to the nozzle-equipped annular bit 4, without too much loss of pressure, and having a bursting limit high enough to provide a sufficient safety factor with respect to the maximum to the service pressure. In the represented embodiment, around this high-pressure pipe 13 a spiral spring 14 is tightly wound, serving as protection against wear and to increase in addition the rigidity under torque. The high-pressure hose pipe 13 and the spiral spring 14 are mounted with sufficient play in a jacket tube 15, which is also made of a spiral spring with tightly wound adjacent turns. The annular space 16 between the spiral spring 14 and the jacket tube 15 is filled with lubricants, advantageously grease, in order to reduce the mutual friction resulting from the turning of the high-pressure hose pipe 13 is the non-rotatably mounted jacket tube 15. For this purpose the inner wall of the jacket tube 15 made of a spiral spring can be coated with a corresponding liquid-proof layer. The construction of the jacket tube 15 as a spiral spring with adjacent turns results in sufficient stability of the jacket tube in extension position and still ensures its deflection by corresponding deflection forces.

Figure 3:
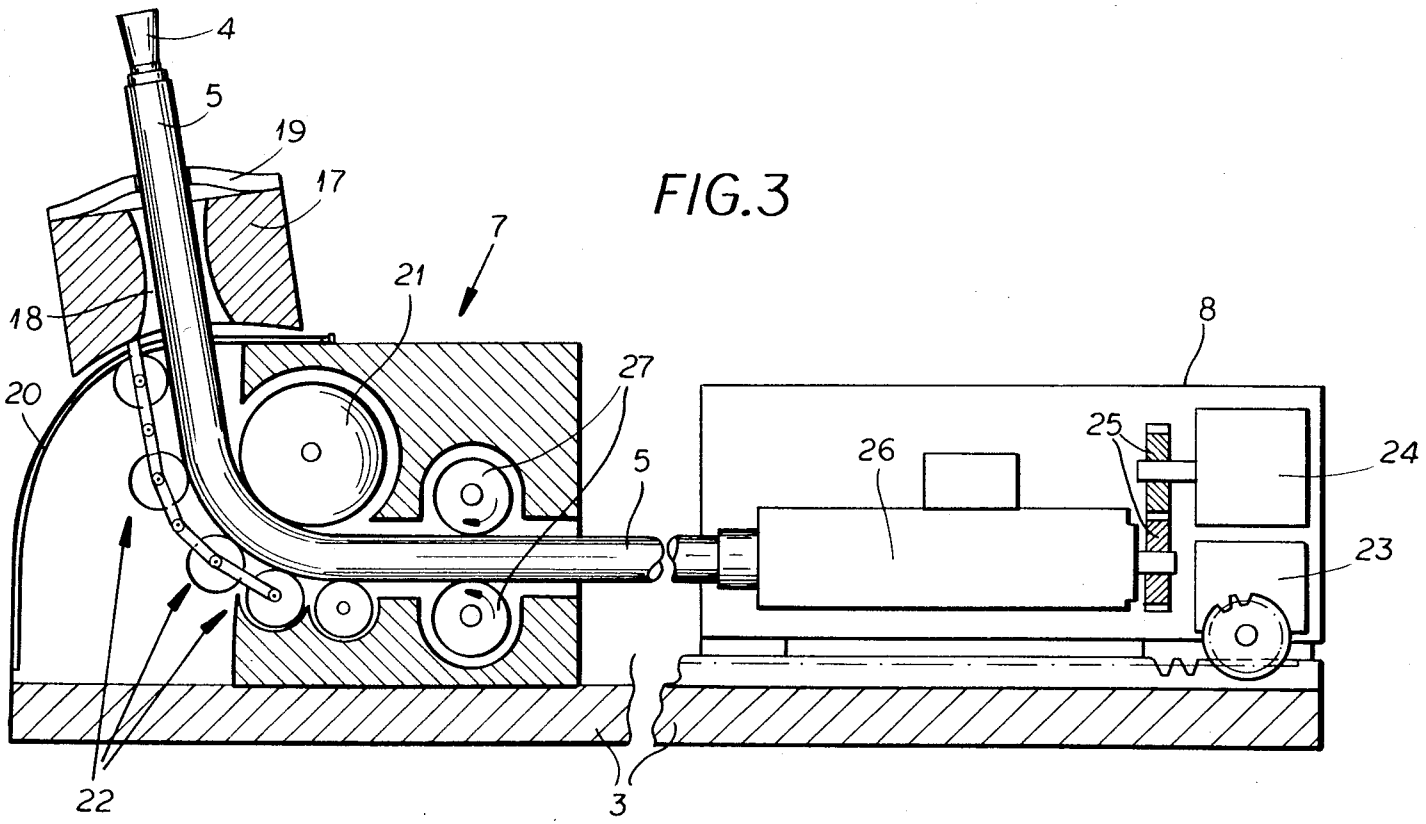
FIG. 3 is a section through the apparatus.

FIG. 3 shows the basic construction and the mode of operation of the equipment for angular drilling with high-pressure water. In front of the drill hole there is a center bit guide 17 which provides the precise guidance in the desired angle of the jacket tube 15 and of the therein mounted high-pressure hose pipe carrying the nozzle-equipped annular bit 4, during the drilling start. The center bit guide 17 has a bore 18 which guides the jacket tube 15 in the desired direction during the regular drilling process. The center bit guide is covered by a sleeve 19 which prevents the drilling water and the detritus exiting the drill hole mouth from soiling the center bit guide and the rest of the mechanical devices and from cementing after drying. The center bit guide 17 is displaceable and fastenable along a guidance curve 20 of the deflection device 7 by a working gear not shown in detail. A deflection roller 21 and a roller-chain type guide 22 which can be adjusted in their bending radius and deflection angle with respect to the center bit guide 17 ensure the actual deflection, whereby the totality of the roller are so shaped as to optimally encompass the jacket tube 15.

The drilling machine 8 can be moved on the drill carriage 3 by means of an advance drive 23, whereby for producing a variable advance speed automatically adjustable to the needs of the drilling process, the advance drive can be a hydraulic, electric or pneumatic motor with adjustable turning speed. A further adjustable motor 24 produces the turning motion required for drilling via a gearing 25, whereby the high-pressure water from the high-pressure pump 10 is supplied to the high-pressure hose pipe 13 via a rotatable pressure-water feeder 26.

Also by means of a variable speed drive not represented in the drawing, the live rollers 27 which exert an adjustable and reduced traction force on the jacket tube 15 are mounted in the deflecting device 7. The variable speed motors for the live rollers 27 as well as the propulsion drive 23 and the motor 24 can be connected to each other via a control system, whereby data about the drilling progress are fed to the control system and via its linkage switches ensure atuomatically an optimal cooperation of the drives and thereby an optimal drilling process. The water pressure of the high-pressure pump 10 can also be coordinated through this control and adjustment system.

Figure 4:
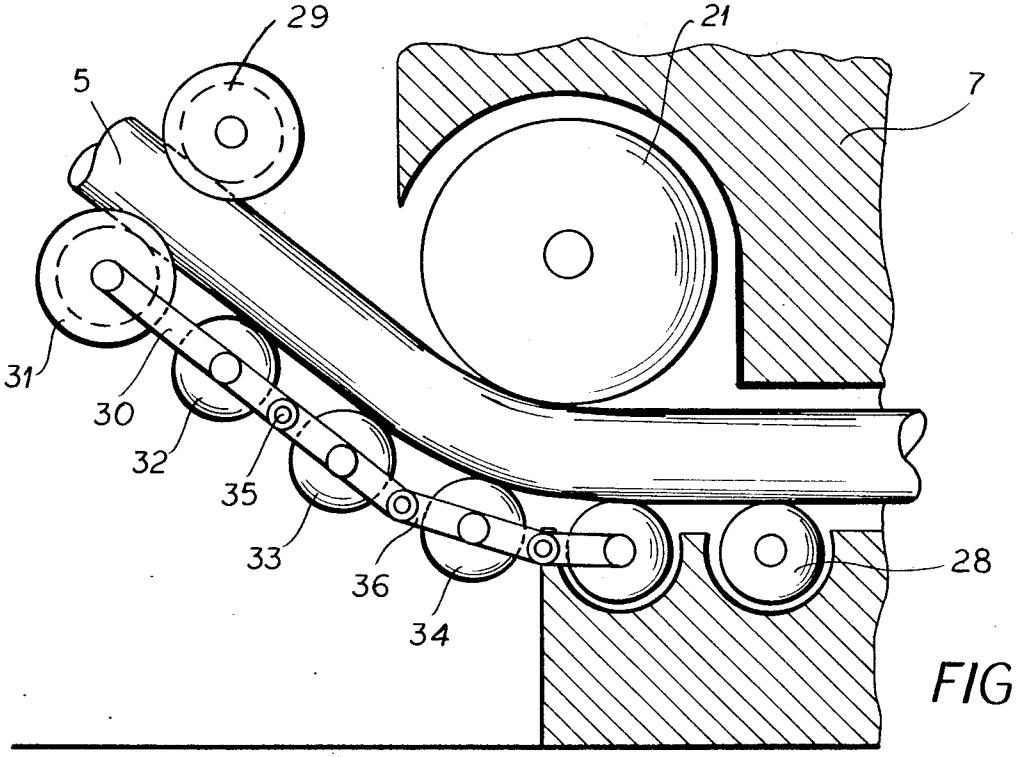
FIG. 4 is a section of the deflection system in detail.

In FIG. 4 the main details of the deflection device 7 are shown. A deflection roller 21 with a large diameter, which is shaped to accommodate the outer circumference of the jacket tube 15, entrance rollers at the entrance 28 and exit rollers at the exit 29 each ensure a trouble-free entering and exiting run of the jacket tube 15. The actual angle-changeable deflection occurs due to the roller-chain type guide 22 having guide rollers 31 to 24, which are mounted on bearing elements 36 connected to each other via links 35 in a chain-like manner. The roller-chain type guide 22 is connected to the center bit guide 17 as already mentioned, in such a way that the center bit guide 17 and the roller-chain type guide 22 move together simultaneously when the deflection angle is changed.

Figure 5:
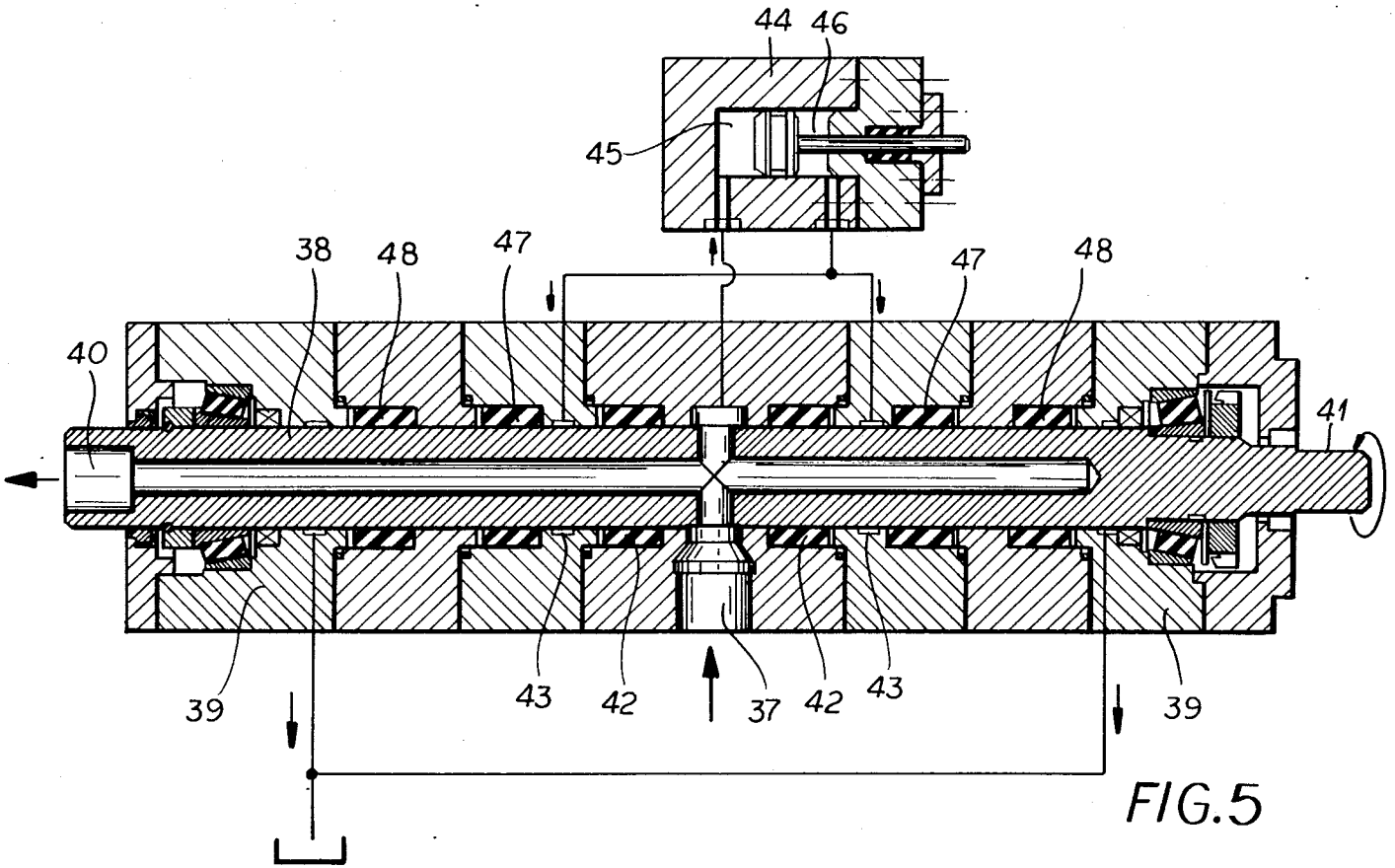
FIG. 5 is a longitudinal section through the feeding inlet for the pressure water according to the invention.

FIG. 5 shows the essential parts of the pressure-water feeder 26. This pressure-wsater feeder 26 has a hollow shaft 38 which is rotatably pivoted in a pressure housing 39, openings 37 in the center for the passage of the high-pressure water and a connection 40 for connecting the high-pressure hose pipe 13 at one end. The turning drive of the shaft is achieved at its opposite end 41 with the aid of the motor 24 and the gearing 25 shown in FIG. 3. In order to achieve an axial balance of forces the sealing elements for the hollow shaft 38 are symmetrically arranged. The main seal occurs at both insulating sleeves 42. But since radial seals do not insure a trouble-free and absolute seal under extended exposure to very high water pressures, the sealing sleeves 42 are acted upon from their back side through chambers 43 with a second pressure medium of high viscosity, with a pressure slightly higher than the pressure they are to be sealed against. A pressure transmitter 44 subject to the high-pressure water at its full piston surface 45 and to the second pressure medium of high viscosity at its annular surface 46 takes care that the sealing sleeves 42 each be subjected at its rear side to a somewhat higher pressure than the operation pressure, thus achieving an absolute seal against the high-pressure water. Two additional sealing sleeves 47 insulate the medium of high viscosity. Due to the considerably higher viscosity and the lubricating capability of the second pressure medium no sealing problems arise at this sealing point. The sealing sleeve 48 serve only to avoid losses in the pressure of the high-viscosity medium and the penetration of dust.

I claim:

1. A drilling apparatus for use with a drilling machine having a guide and adapted to drill holes at an angle to said guide, said apparatus comprising in combination:

a rotatable annular bit adapted to cut a hole in a rock and provided with high-pressure water-jet nozzles;

a high-pressure pipe connected to said bit at one end thereof and connectable to a high-pressure pump, said pipe being constructed to be rigid under torsion;

a rotary drive displaceable along said guide and forming part of said machine, said drive being coupled to said pipe for rotating same whereby upon rotation of said pipe, torque is applied thereto to generate a torsion which renders said pipe rigid;

a nonrotatable jacket tube rotatably receiving said pipe, elastically deflectable into a bent condition from a straight condition and substantially rigid in radial direction;

a deflecting means including a deflection device located at an end of said guide and adapted to be positioned in the region of a mouth of a hole to be drilled for angularly deflecting said tube and said pipe to establish an angle at which a hole is to be drilled relative to said guide; and means for axially displacing said tube and said pipe along said guide at a location remote from said bit whereby said tube and said pipe are displaced together through said deflection device in a longitudinal direction to advance drilling of said hole, said deflection devide comprising an element having an aperture through which said tube and said piep are passed and mounted to swing at an extremity of said guide, a main deflection roller disposed in said guide at said extremity, and a roller chain having a plurality of auxiliary rollers disposed opposite said main deflection roller and a coupled to said element.

2. The apparatus defined in claim 1 wherein said tube consists of a spiral spring wound in a multiplicity of adjacent turns of spring steel wire.

3. The apparatus defined in claim 1 wherein said pipe is formed with a wear-resistant sleeve constituted by a spiral spring tightly wound around a hose in a multiplicity of adjacent turns.

4. The apparatus defined in claim 1 wherein said tube is provided with a liquid-proof coating, further comprising grease interposed between and filling spaces formed between said tube and said pipe.

5. The apparatus defined in claim 1, further comprising a sleeve mounted on said element for preventing an incursion of mud deriving from said hole.

6. The apparatus defined in claim 1 wherein said guide is provided with a pair of driven rolles engaging said tube for advancing said tube and said pipe through said element.

7. The apparatus defined in claim 1 wherein said guide is an elongated drilling track and a drill carriage is mounted on said drilling track, said tube and said pipe being advanced into said hole by displacement of said carriage along said track.

8. The apparatus defined in claim 1, further comprising a high-pressure feeder connected to said pipe at an end thereof remote from said bit and connected, in turn, to said pump, said high pressure feeder having a hollow shaft connected with said pipe and rotatably driven to rotate said pipe and apply said torque thereto.

9. The apparatus defined in claim 8, further comprising seals engaging said shaft and means for breaking each of said seals with a fluid of higher viscosity than water to prevent leakage of said seal.

10. The apparatus defined in claim 9 wherein the last mentioned means includes a pressure transmitter.

* * * * *